US007513859B2

(12) United States Patent
Schmieder et al.

(10) Patent No.: US 7,513,859 B2
(45) Date of Patent: Apr. 7, 2009

(54) FOLDING DEVICE FOR PRINTING PRESSES OR FOLDERS

(75) Inventors: Frank Schmieder, Plauen (DE); Stefan Uhlemann, Plauen (DE); Ralf Werner, Plauen (DE); M. Mario Winkler, Plauen (DE)

(73) Assignee: manroland AG, Offenbach am Main (DE)

( * ) Notice: Subject to any disclaimer, the term of this patent is extended or adjusted under 35 U.S.C. 154(b) by 6 days.

(21) Appl. No.: 11/123,314

(22) Filed: May 6, 2005

(65) Prior Publication Data

US 2005/0266976 A1 Dec. 1, 2005

(30) Foreign Application Priority Data

May 7, 2004 (DE) ..... 10 2004 023 318

(51) Int. Cl.
*B31F 1/00* (2006.01)

(52) U.S. Cl. ..... 493/416; 493/422; 493/423; 493/441

(58) Field of Classification Search ..... 493/416, 493/422, 423, 425, 427, 434, 437, 441
See application file for complete search history.

(56) References Cited

U.S. PATENT DOCUMENTS 147,052 A * 2/1874 Forsaith ..... 493/416
2,770,457 A * 11/1956 Jesus ..... 493/23
3,493,226 A * 2/1970 Weir ..... 493/19
3,761,071 A * 9/1973 Behn ..... 493/416
3,904,186 A * 9/1975 De Ligt ..... 493/422
4,300,895 A * 11/1981 Meenen ..... 493/416
4,614,512 A * 9/1986 Capdeboscq ..... 493/441
4,648,336 A * 3/1987 Ragnebring ..... 112/147
4,747,817 A * 5/1988 Newsome ..... 493/438
5,090,672 A * 2/1992 Ballestrazzi et al. ..... 270/45
5,899,843 A 5/1999 Stäb
5,997,459 A * 12/1999 Kruger et al. ..... 493/441

FOREIGN PATENT DOCUMENTS

DE 196-42-124 * 4/1998

* cited by examiner

*Primary Examiner*—Sameh H. Tawfik
(74) *Attorney, Agent, or Firm*—Leydig, Voit & Mayer, Ltd.

(57) ABSTRACT

The invention relates to a folding device for printing presses or folders which does not require pressure brushes for fixing the printed product on surface inlet and outlet sections folding table. The folding device (11) which includes a folding table (4), at least one stop (8) associate with the folding table (4), a plurality of transfer belts (5) for engaging and transferring printed products (3) onto said folding table to said at least one stop, a pair of rotatably driven folding rolls (7), a folding blade (2) moveable relative to the folding table (4). The transport belts (5) can be set against inlet and/or outlet sections (9, 10) of the folding table (4) forming full-area contact in order to fix the printed product (3) in position for folding, and the inlet and/or outlet sections (9, 10) are situated just in front of and just behind the printed product (3).

17 Claims, 2 Drawing Sheets

FOLDING DEVICE FOR PRINTING PRESSES OR FOLDERS

FIELD OF THE INVENTION

The invention relates to a folding device, and more particularly, to a device for folding printed sheet material in printing presses or folders.

BACKGROUND OF THE INVENTION

DE 196 42 124 A1 has disclosed a folding device, comprising a driven pair of folding rolls, a folding blade which moves up and down synchronously, and a folding table. A printed product or an individual sheet is gripped by a plurality of transport belts, moved in the production direction against stops and subsequently provided with a longitudinal fold, for example a third fold. The printed product can be pressed against the folding table by means of pressure springs or pressure rollers for better retention during the folding procedure. Such pressure springs and pressure rollers are disadvantageous in that they constitute additional components which impair accessibility to the folding table region for maintenance and during operation of the printing press.

OBJECTS AND SUMMARY OF THE INVENTION

It is the object of the present invention to provide a folding apparatus for printing presses or folders which operates effectively without pressure rollers or pressure springs for maintaining the printed product on the folding table in a fixed position.

The invention consists, in particular, of providing contact zones for fixedly maintaining the product at a stop for the printed product to be folded and/or adjacent an end of the printed product, such as in a region of from 2 to 15 mm just in front of and/or just behind the product, with the contact zones being formed by means of the variable-position transport belts in conjunction with inlet and/or outlet sections of the folding table. The said inlet and outlet sections lie somewhat lower and run onto the folding-table plane in a rounded manner and/or in a step-like manner with shoulders. The inlet and/or outlet sections preferably lie in regions of the leading and/or trailing product ends which are wrapped around the inlet and outlet sections of the table by transport belts, their pressure effect on the printed product being brought about by variable-position belt-guiding elements, preferably belt rolls or belt rollers, the positional change of which brings about a change in the wrap-around degree in the contact zones. The wrap-around change is understood to mean a change to or setting of the length of the contact between transport belts and the folding table or the inlet and outlet sections.

In contrast to known solutions which form relatively small contact zones by linear contact of the springs or belt rollers, the size of the contact zone can be much greater by virtue of the wrap-around effect of the belts, and improved holding of the product can be achieved. The printed product is additionally guided in a more stable manner during its arrival onto the folding table as a result if its slight arching. It is thus not possible for any oscillations to occur which can influence the position of the incoming printed product. For this purpose, the folding table is configured with an arching or arched shape in the region of the product inlet.

High stability in folding quality, in conjunction with simplification of operation, can be achieved with this arrangement. Taut guidance of the printed product during the folding procedure further substantially reduces folding deviations. Waste also can be reduced by processing products more quickly without folding deviations. The system further is less susceptible to disturbances and the operation of the folding device can be improved considerably. The transport belts which are already present in the folding device can be configured with the function of wrap-around settings, with the result that it is possible to integrate this function into existing components and thus no further components are required which would limit the operating space and impede accessibility.

A contact zone for the purpose of forming a product-fixing or maintaining means in conjunction with adjustable belt-guiding elements can be effected by edges and/or radii at the product stop and directly behind the end of the printed product, that is to say on the folding table in the region of the product inlet. The edges and/or radii which are preferably configured as milled-out sections and slopes serve to change the wrap-around degree in the contact zones and thus to make it possible to set the contact force.

Other objects and advantages of the invention will become apparent upon reading the following detailed description and upon reference to the drawings, in which:

Figure 1:
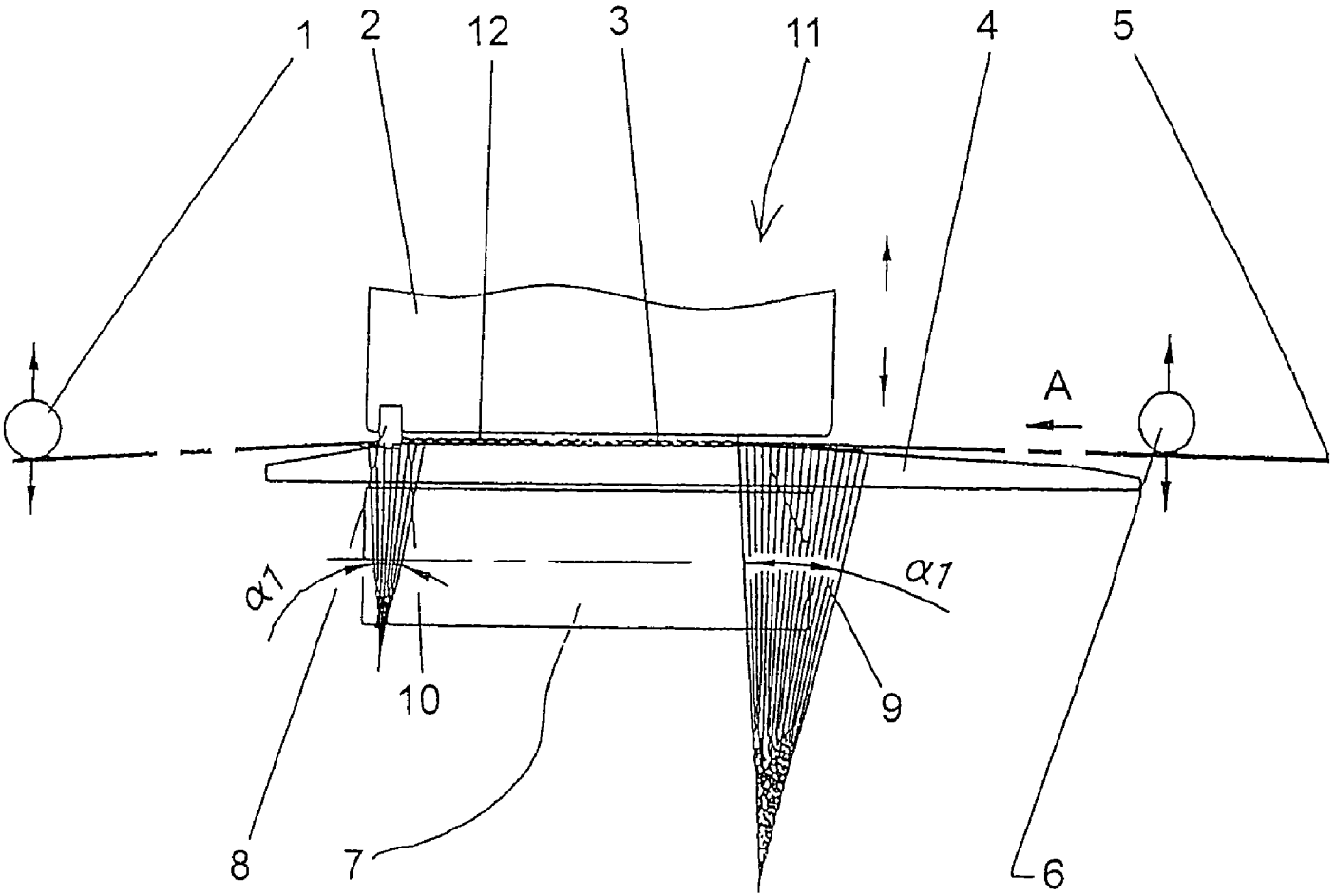
FIG. 1 is a side elevational view of a folding table having a folding device in accordance with the invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE INVENTION

Referring now more particularly to FIG. 1 of the drawings, there is shown an illustrative folding device 11 in accordance with the invention designed for usage in a printing press or a sheet folding apparatus. The illustrated folding device 11 includes a folding table 4 onto which printed products on other sheet material 3 are direct following printing in the printing press, at least one stop 8 for locating the printed product 3 in position for folding, a pair of driven folding rollers 8 of a conventional type, and a folding blade 2 adapted for vertical movement in synchronism with the direction printed product onto the folding table 4 for effecting a longitudinal fold, for example a third fold, into the printed product 3 in the conventional manner. For engaging and moving the printed product 3 onto the folding table 4 in a product feed or inlet direction A, a plurality of transport belts 5 are driven along the top of the table.

In accordance with the invention, the folding table has contoured inlet and outlet sections which can be encompassed by the drive belts for more reliable high speed operation of the folding device. The folding table 4 in this case has a central substantially flat planar sheet receiving section 12, an inlet section 9 extending in the printed product feed direction A gradually upwardly from a level below the central planar section 12 and an outlet section 10 that extends gradually downwardly from the central planar section 12. The inlet and outlet sections 9, 10 in this instance are near the ends of the product in regions α1, α2, such as from 2 to 15 mm just in front of or just behind the printed product. The outlet section 10 in this case is adjacent the stop 8. The inlet and outlet sections 9, 10 are designed to receive the transport belts in wrap around fashion to create contact zones between the printed product in the inlet and outlet sections with a pressure that can be selectively controlled.

Figure 2:
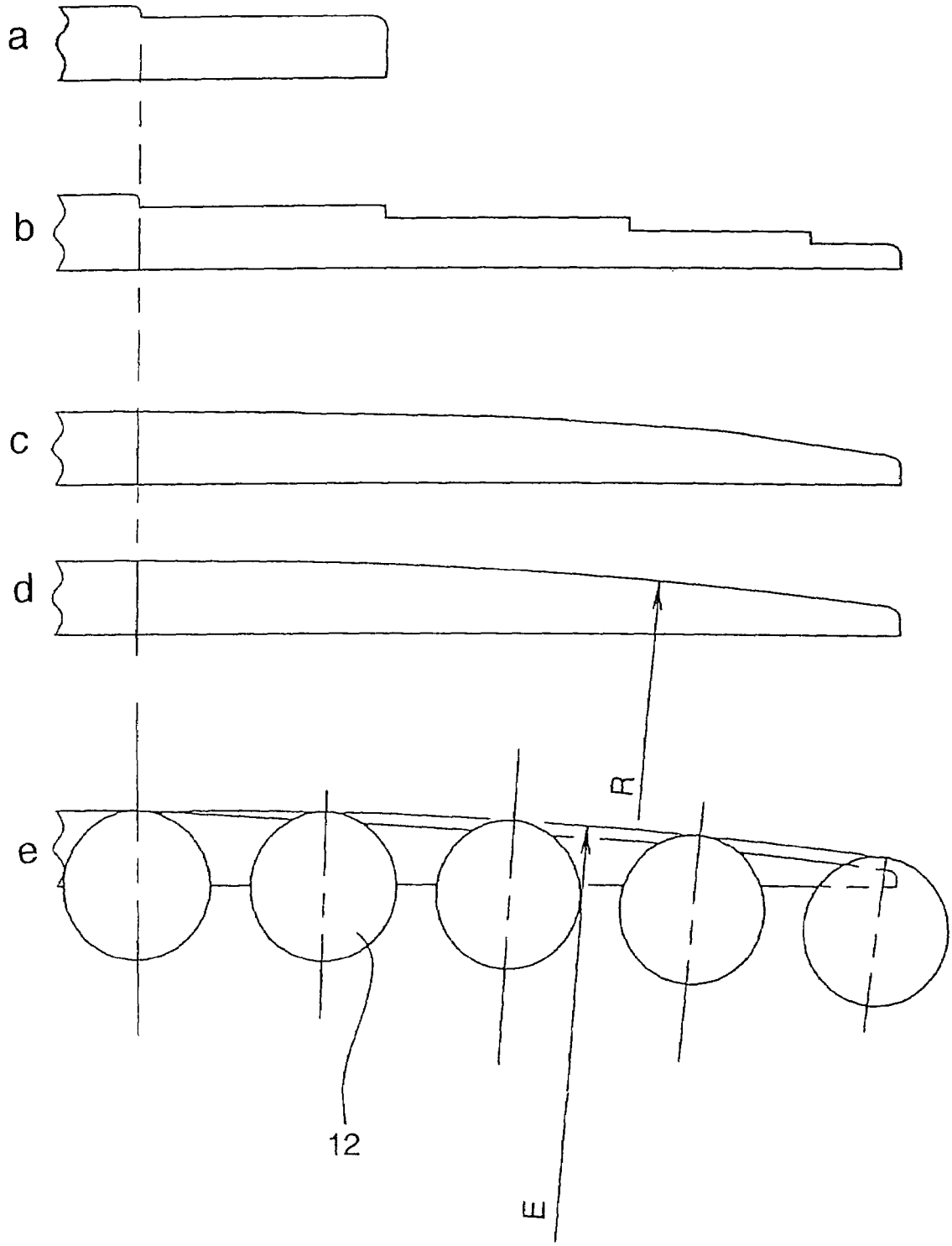
FIG. 2 shows alternative configurations of the product inlet region of the folding table according to the invention.

In keeping with the invention, vertically moveable belt guiding elements 1, 6 are provided for vertically positioning the transport belts 5 in the inlet and outlet sections 9, 10 with the desired wrap around and pressure for particular folding operations. The belt guiding elements 1, 6 preferably are belt rolls or rollers that are vertically moveable for lowering the transport belts into contact with the inlet and outlet sections 9, 10, which preferably are formed with a contoured configuration without sharp edges. In the illustrated embodiment, the inlet and outlet sections have a rounded configuration, with straight sections at the ends thereof. Alternatively, the inlet and outlet sections may be configured with milled out sections which are radiused (as depicted as variance a-c in FIG. 2). The inlet and outlet sections 9, 10 also may be configured with a radius R (as depicted in FIG. 2 as variant d), or inlet rolls or rollers 12 can be provided to simulate an equivalent radius E (as depicted in FIG. 2 as variant e). It can be seen that vertically positional changes in the belt guiding elements 1, 6 will change the degree of belt wrap around on the inlet and outlet sections 9, 10, i.e., a change in the length of contact between the transport belts 5 and the table inlet and outlet sections 9, 10. The vertical positional change of the transport belts 5 in conjunction with shaping of the inlet and outlet sections 9, 10 makes it possible to adjust the degree of wrap around of the belt with the inlet and outlet sections. This adjustment can be selectively established for different length printed products, different printed formats, and different paper properties. The force of the belts, and hence the force of the printed products on the folding table, also can be adjustably established for the particular printing operation.

The folding table 4 preferably is made of a hard-chromed finish for reduced wear. Alternatively, appropriate hardened, exchangeable elements, such as bolts, rails, and the like, could be provided in the inlet and outlet sections 9, 10. The belt guiding elements 1, 6 also can be eccentrically mounted rolls. In such case, it is possible to correct oblique positioning of printed products through appropriate eccentric mounting of the belt guiding elements 6 at the inlet of the folding table.

It will be understood that the inlet and outlet sections 9, 10 may have different configurations, as depicted in FIG. 2, for particular sheet and folding requirements. For example, as indicated, variant a in FIG. 2 shows a shortening of the folding table, variant b shows a folding table 4 with step-like shoulders, variant c shows a folding table 4 with slopes, variant d shows a folding table 4 with a large inlet radius R, and variant e shows a folding table 4 with inlet rolls or rollers 12 which simulate an equivalent radius E. The folding table 4 preferably is of arched configuration in the product inlet direction for causing the printed product 3 to be arched during entry. The printed product may have a flat configuration at the inlet and outlet sections 9, 10 and between those sections. The arch configuration brings about positional stability during guidance of the printed products onto the folding table. The belt-guiding elements 1, 6 and the transport belts 5, furthermore, as indicated above, can be set for different product thicknesses through adjustability of the belt guiding elements 1, 6.

The invention claimed is:

1. A folding device for folding printed products in printing presses and folding machines comprising a folding table having a length that extends in a product feed direction and a width that extends perpendicular to said product feed direction, at least one stop associated with the folding table, a plurality of transfer belts for engaging and transferring printed products in said product feed direction onto said folding table to said at least one stop, a pair of rotatably driven folding rolls, and a folding blade moveable relative to the folding table in synchronism to the transfer of printed products to the at least one stop, wherein said transfer belts are guided by belt guiding elements which are moveable in a direction perpendicular to said product feed direction and perpendicular to said width of the folding table such that the transfer belts are moveable between a lowered position in which the transfer belts form a full area contact with the folding table for fixing the printed product on the table during a folding operation and a raised position relative to the folding table, and wherein the folding table has a sheet receiving area in a first folding table plane where printed product is folded by the folding blade, printed product to be folded being fed from an inlet section of the folding table to the sheet receiving area in the product feed direction and the folding table has an outlet section in the region of said stop that extends lower than the folding table plane as the outlet section extends in the product feed direction away from the sheet receiving area.

2. The folding device of claim 1 in which the inlet and outlet sections are respectively located just in front of and just behind the printed product when the printed product is located at the at least one stop on said folding table, and said transfer belts position printed products against said inlet and outlet sections when in said lowered position.

3. The folding device of claim 2 in which the raised and lowered positions of said belts may be selectively set to accommodate a desired contact force of printed products on the fold table for different printed product thicknesses.

4. The folding device of claim 2 in which the raised and lowered positions of said belts relative to the folding table can be selectively set to establish a length of contact of the belts with said inlet and outlet sections dependent upon the desired contact force of the printed products on the folding table and the different thicknesses of the printed product.

5. The folding device of claim 1 in which said outlet section lowers from said folding table plane in a radiused path.

6. The folding device of claim 1 in which said outlet section lowers from said folding table plane in at least one step.

7. The folding device of claim 1 in which said belts contact said folding table inlet and outlet sections when in said lowered position for guiding printed products onto and from the folding table central section.

8. The folding device of claim 1 in which said folding table has a hard chrome finish.

9. The folding device of claim 1 in which said belt guiding elements are rollers.

10. The folding device of claim 9 in which said eccentrically mounted belt guiding elements are positionable for correcting oblique positioning of the printed product as it arrives on the folding table.

11. The folding device of claim 1 in which said belt guiding elements are eccentrically mounted.

12. The folding device of claim 1 including hardened elements releasably mounted in said inlet and outlet sections.

13. The folding device of claim 1 in which said inlet and outlet sections are devoid of any sharp edges against which printed product engages upon movement to and from the folding table central section.

14. The folding device of claim 1 in which the folding table defines an substantially straight uncurved path of movement of printed products between said inlet and outlet sections.

15. The folding device of claim 1 in which the inlet section is disposed lower than the folding table plane which rises up to the level of the folding table plane in the product feed direction.

16. The folding device of claim 15 in which said inlet section rises to said folding table plane in a radiused path.

17. The folding device of claim 15 in which said inlet section rises to said folding table plane in at least one step.

* * * * *